US008025558B2

(12) United States Patent
Prause et al.

(10) Patent No.: US 8,025,558 B2
(45) Date of Patent: Sep. 27, 2011

(54) POWER SANDER WITH NOVEL SANDING SHEET TENSION CLAMPING

(75) Inventors: Carsten Prause, St. Augustin (DE); Heiko Roehm, Stuttgart (DE); Daniel Vesenmaier, Leinfelden (DE); Andreas Heber, Filderstadt (DE)

(73) Assignee: Robert Bosch GmbH, Stuttgart (DE)

( * ) Notice: Subject to any disclaimer, the term of this patent is extended or adjusted under 35 U.S.C. 154(b) by 635 days.

(21) Appl. No.: 12/089,489

(22) PCT Filed: Jul. 12, 2007

(86) PCT No.: PCT/EP2007/057150

§ 371 (c)(1),
(2), (4) Date: Apr. 7, 2008

(87) PCT Pub. No.: WO2008/015087

PCT Pub. Date: Feb. 7, 2008

(65) Prior Publication Data

US 2008/0214098 A1 Sep. 4, 2008

(30) Foreign Application Priority Data

Aug. 2, 2006 (DE) ..... 10 2006 035 977

(51) Int. Cl.
*B24B 15/00* (2006.01)

(52) U.S. Cl. ..... 451/514; 451/519

(58) Field of Classification Search ..... 451/514–519
See application file for complete search history.

(56) References Cited

U.S. PATENT DOCUMENTS

| | | | | |
|---|---|---|---|---|
| 2,715,804 | A * | 8/1955 | Wickes | 451/356 |
| 3,540,161 | A | 11/1970 | Anton et al. | |
| 3,546,822 | A * | 12/1970 | Hutchins | 451/344 |
| 4,077,165 | A * | 3/1978 | Hutchins | 451/518 |
| 4,330,964 | A * | 5/1982 | Martinez | 451/357 |
| 4,625,462 | A * | 12/1986 | Fushiya et al. | 451/357 |
| 4,922,663 | A * | 5/1990 | Nakagawa et al. | 451/359 |
| 5,616,072 | A * | 4/1997 | Walz et al. | 451/356 |
| 6,857,948 | B2 * | 2/2005 | Bocka et al. | 451/356 |
| 6,887,143 | B2 * | 5/2005 | Bocka et al. | 451/359 |
| 7,131,899 | B2 * | 11/2006 | Gansel et al. | 451/514 |
| 2005/0085172 | A1 | 4/2005 | Gansel et al. | |
| 2006/0172670 | A1 | 8/2006 | Gyoergy | |

FOREIGN PATENT DOCUMENTS

| | | |
|---|---|---|
| CN | 1668422 | 9/2005 |
| DE | 102 32 055 | 2/2004 |
| DE | 103 23 640 | 12/2004 |
| DE | 103 53 682 | 6/2005 |
| GB | 2 402 095 | 12/2004 |

* cited by examiner

*Primary Examiner* — Maurina Rachuba
(74) *Attorney, Agent, or Firm* — Michael J. Striker

(57) ABSTRACT

Portable sander, in particular an orbital sander, having an abrasive sheet carrier (1) and having clamping means (3) for firmly clamping opposite abrasive sheet ends of an abrasive sheet (21) which can be supported on the abrasive sheet carrier (1), wherein first clamping means (3) together with an abrasive sheet end clamped thereon can be moved away from the other abrasive sheet end, clamped by means of second clamping means (3), for tensioning the abrasive sheet (21), and the first clamping means (3) have spring elasticity. Provision is made for the first clamping means (3) to come against a rigid stop element (9) with prestress in an end clamping position.

14 Claims, 3 Drawing Sheets

POWER SANDER WITH NOVEL SANDING SHEET TENSION CLAMPING

PRIOR ART

Power sanders, in particular orbital sanders, are widely distributed. They are used for abrasively machining surfaces. The holder of the abrasive, which is usually embodied as a sanding sheet (in the case of an orbital sander, typically as a rectangular sanding sheet), must be fixed in a suitable way on a sanding sheet holder so as not to slide off the sanding sheet holder in the motions, which as a rule are elliptical or circular, that bring about the abrasion, and so as not to execute an unwanted relative motion with respect to the sanding sheet holder.

In the prior art, a large number of clamping devices are known for this purpose. On the one hand, sanding sheets with a hooklike coating on the back are used, which remain stuck to a sanding sheet holder equipped specifically for this because of the actions of a hook-and-loop closure. On the other hand, clamping bail or clamping roller systems are known, in which the sanding sheet is clamped in place on a front and back side of the sanding sheet holder and tension-clamped over the outer edges of the sanding sheet holder. Clamping bail systems which are actuated via a tensioning lever prove to be especially easy to manipulate; the tensioning levers are embodied on at least one short side of the sanding sheet holder, and in addition to the clamping bail a spring stop element is provided; the sanding sheet is placed between the clamping bail and the spring stop element, and by a motion of the clamping bail or its tensioning lever, both the clamping bail and the spring stop element, with the paper clamped between them, are tension-clamped. The tensioning lever is fixed in a terminal position and produces the final tension of the paper on the sanding sheet holder. A tensioning system of this kind is known for instance from German Patent Disclosure DE 102 32 055, which is considered to be the closest prior art.

Since the spring stop element and the clamping bail are protruding elements that are essentially movable and/or elastic, vibration is induced in them that can excite resonance. This vibration (particularly in the event of resonance) can not only lead to greater wear of the components but also make for poorer-quality work. To assure secure clamping of the sanding sheet despite this vibration, relatively high tensile stress must be exerted and clamped with great force. As a result of the strong clamping forces required here and their engagement points that are located far apart, it is possible for the sanding sheet holder to be deformed. Moreover, resonance can be reduced only if the individual components are embodied with a relatively great material thickness, so that they can withstand the relatively strong forces that act on them. In addition, the clamping elements must be embodied as relatively strong, so that they can transmit the strong tensioning forces, which by itself leads to greater weight. As a result, the center of gravity of the sanding sheet holder shifts, and the components mounted on it shift out of the middle (the region of the axis of oscillation), creating greater vibration that in turn induces vibration in the system and leads to both greater wear and poorer-quality work.

Moreover, the spring stop element and the clamping bail are parts that are relatively complicated to manufacture, resulting in high production costs. Assembling the clamping system is done using a relatively large number of individual parts, making for high effort and expense for assembly.

The object of the invention is to furnish a power sander which has a clamping system that overcomes the aforementioned disadvantages.

SUMMARY OF THE INVENTION

To that end, a power sander, in particular an orbital sander, is proposed, having a sanding sheet holder and having clamping means for firmly clamping opposed sanding sheet ends of a sanding sheet that is capable of being braced on the sanding sheet holder, of which first clamping means are movable jointly with a sanding sheet end clamped to them away from the other sanding sheet end, clamped by means of second clamping means, for tension clamping of the sanding sheet, and the first clamping means have spring elasticity. It is provided that the first clamping means, in a terminal clamping position, act with initial tension against a rigid stop element. Accordingly, in a distinction from the prior art, the first clamping means in its terminal tensioning position is kept in force equilibrium not only by the tensile force of the clamped sanding sheet and on the other by the spring tension of the first clamping means. On the contrary, the stop element acts to assure a defined terminal tensioning position for the first clamping means and in particular to assure a stable position with force dissipation; as a result, free vibration of the first clamping means in operation of the power sander no longer occurs. The prerequisite in each case is that the sanding sheet is first fixed in the second clamping means (which may be embodied in the conventional way); the final tensioning of the sanding sheet is always accomplished by the first clamping means.

In a further embodiment of the invention, it is provided that the stop element is either embodied in one piece with the sanding sheet holder or is embodied as a separate part from the sanding sheet holder and is rigidly connected to the sanding sheet holder. In the first variant, the stop element is structurally an integrally embodied part of the sanding sheet holder, for instance by means of embodying at least one lug or a support on the end of the sanding sheet holder associated with the first clamping means. In the second variant, while the stop element is a separate component, nevertheless it is rigidly joined to the sanding sheet holder, for instance screwed to it. What is essential to the invention here is that the stop element not execute any relative motion to the sanding sheet holder but instead is solidly joined to it.

In a preferred embodiment, it is provided that the stop element is embodied adjustably, in particular angularly adjustably, relative to the sanding sheet holder. This means that the stop element can assume various positions relative to the sanding sheet holder, but in these positions it either is or can be joined solidly to the sanding sheet holder. This is possible for instance by embodying the stop element as rotatably supported on the sanding sheet holder, so that it can be fixed in its desired terminal position by suitable devices (for instance being screwed or latched).

In a further embodiment, it is provided that the first clamping means and/or the second clamping means, at least partially and/or in parts and/or in partial regions, have elastically deformable gripping aids, in particular of rubber. Typically, the first clamping means are made from metal or other elastic materials. As such, they intrinsically have fairly smooth surfaces, so that in unfavorable cases, the sanding sheet is capable of executing a relative motion with respect to them, and in extremely unfavorable cases can even slip out. To avoid this and to enable one-handed fastening of the sanding sheet, elastically deformable gripping aids are applied or attached in at least portions of the first clamping means and by means of their elastic deformation or adhesiveness they securely grasp the sanding sheet. Preferably, these gripping aids are of rubber, and the rubber can be applied as a coat, vulcanized on, painted on, or applied in some other suitable form.

In a preferred embodiment, the first clamping means are embodied as a clamping bail and a tensioning sheet. The clamping bail and the tensioning sheet are located in such a way that they essentially assume an opposed position, with the sanding sheet located between them. By actuation of the clamping bail, the sanding sheet is clamped between them and is tension-clamped by a further motion of the clamping bail.

In another embodiment, it is moreover provided that the tensioning sheet is supported rotatably about a transverse axis relative to the sanding sheet holder. The tensioning sheet can accordingly execute a pivoting motion relative to the sanding sheet holder. In particular, this makes it possible for the tensioning sheet and the clamping bail in turn to execute a relative motion with the sanding sheet that is to be tension-clamped, and this finally accomplishes the tension clamping.

In a preferred embodiment, it is provided that the tensioning sheet is spring-loaded. By means of a torsion spring, for instance, the tensioning sheet can be provided with a relatively high prestressing, so that the tensioning force that finally achieves the firm embracing of the sanding sheet is brought to bear not relative to the sanding sheet holder but rather between the tensioning sheet and the clamping bail. In this way, considerable relief of the sanding sheet holder from tensioning forces is possible, so that the sanding sheet holder need not be embodied in an unnecessarily heavy and stable way merely to avoid deformation caused by tensioning forces and their opposite forces.

In a further preferred embodiment, it is provided that the tensioning sheet comprises spring-elastic material or has a spring-elastic material. The tensioning sheet can thus in turn effect the prestressing and finally fastening in place of the tensioning sheet between the tensioning sheet and the clamping bail.

In an especially preferred embodiment, it is provided that the clamping bail is supported rotatably about a transverse axis of the sanding sheet holder and has a tensioning lever. With such a construction, very simple and even one-handed operation and sanding sheet clamping is in particular possible.

Further advantageous embodiments of the invention will become apparent from the dependent claims and combinations thereof.

BRIEF DESCRIPTION OF THE DRAWINGS

The invention will be described below in conjunction with drawings.

Shown are

EMBODIMENT(S) OF THE INVENTION

Figure 1:
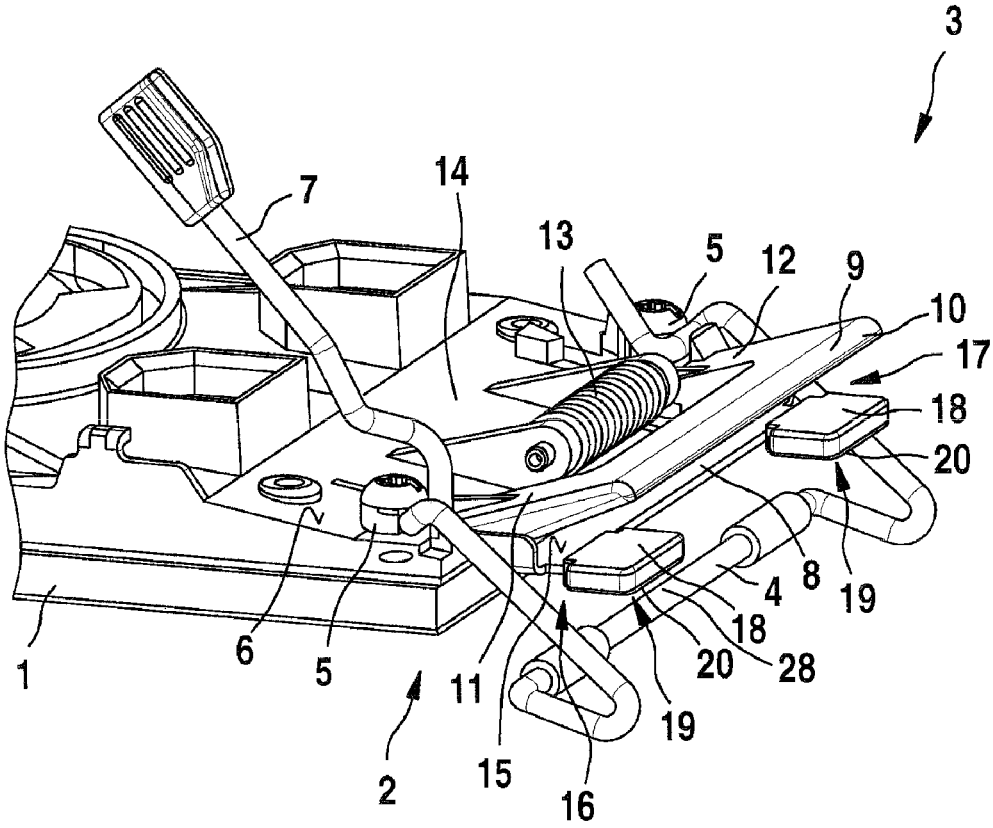
FIG. 1, a sanding sheet holder with a first clamping means, in the open state.

FIG. 1 shows a sanding sheet holder 1 of a power sander, not shown, namely an orbital sander. On its first longitudinal end 2 are first clamping means 3, namely a clamping bail 4, which is supported at bearing points 5 that are located on a top side 6 of the sanding sheet holder 1 and is extended onward in a tensioning lever 7, and a tensioning sheet 8, which is located in the extension of the top side 6 of the sanding sheet holder 1 above the clamping bail 4, namely in particular above a clamping region 28 of the clamping bail 4. Above the tensioning sheet 8 in turn is a stop element 9, in the form of an essentially flat bail 10; the plane of the bail 10 is angled by several degrees out of the plane of the top side 6 of the sanding sheet holder 1. Between a first leg 11 and a second leg 12 of the stop element 9 is a torsion spring 13, which is braced on one side on a region 14 of the top side 6 of the sanding sheet holder 1 and on the other on a top side 15 of the tensioning sheet. In this way, the tensioning sheet 8 is spring-loaded, so that it can be moved in the direction of the stop element 9 only counter to this spring tension. The tensioning sheet 8 has extensions 18 on both a first outer end 16 and a second outer end 17, and these extensions are lined, on at least one underside 19 facing toward the clamping bail 4, with an elastic lining 20, such as rubber. The clamping bail 4 is embodied in bail-like fashion in such a way that on the repositioning of the tensioning lever 8 rotates toward the top side 6 of the sanding sheet holder 1 in the bearing points 5 at least far enough that it comes into contact with the tensioning sheet 8, and preferably with the extensions 18 of the tensioning sheet 8.

Figure 2:
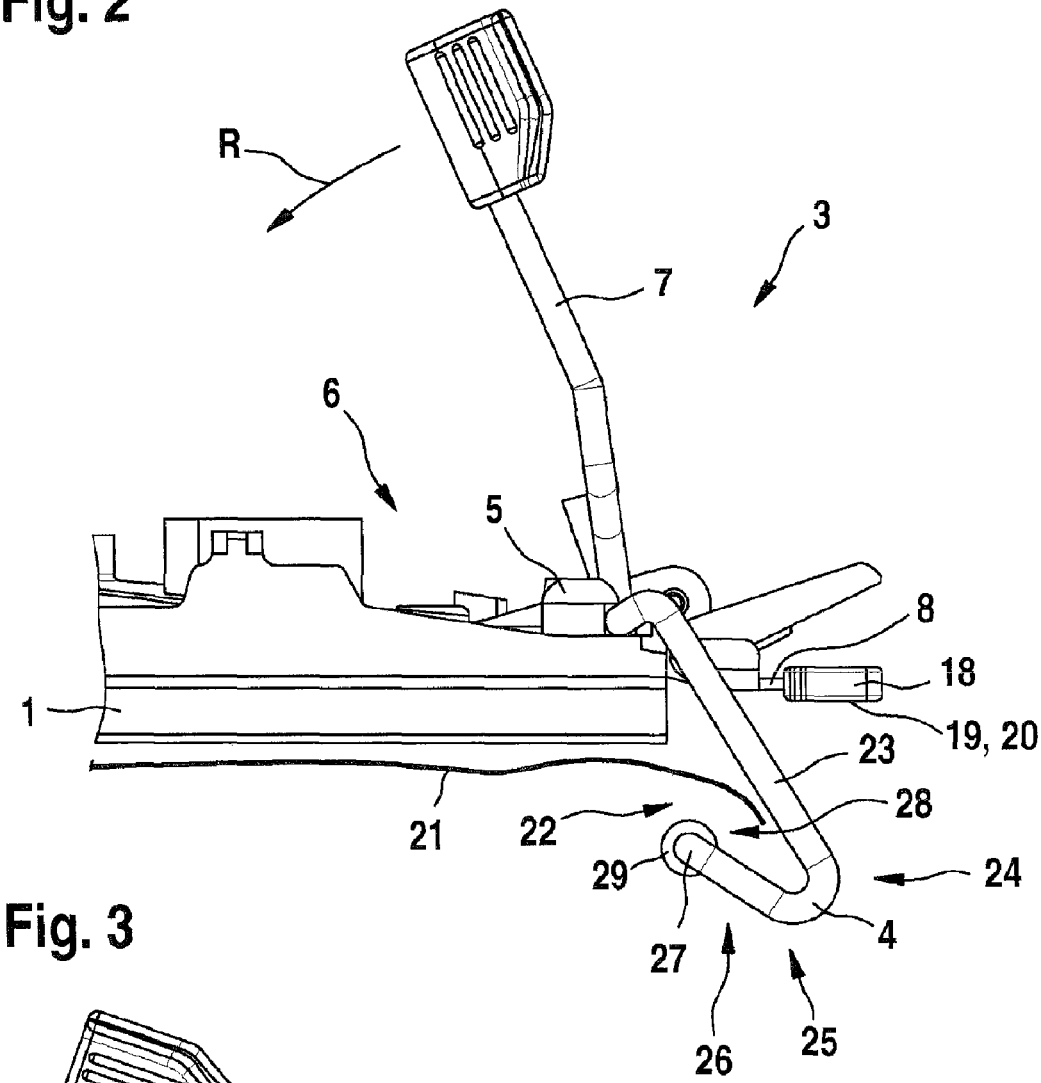
FIG. 2, the first clamping means as the sanding sheet is being put in place.

FIG. 2, in a side view, shows the first clamping means 3 on the sanding sheet holder 1, in the open state. Beneath the sanding sheet holder 1, for the sake of illustration, a sanding sheet 21 is shown loosely before being fastened into the first clamping means 3; its front end 22 protrudes past the sanding sheet holder 1 into the region of the first clamping means 3. It is a prerequisite that the sanding sheet is already fixed in tension-proof fashion on the opposed second clamping means, which are not shown here. In this side view, the embodiment of the clamping bail 4 can be seen quite well. The bail arm 23, on its end 24 farthest from the bearing, has a reverse bend 25, in the form of a wide-open U. A clamp support arm 26 is formed, beginning at the reverse bend 25, and on its end 27 remote from the reverse bend 25, it merges with the clamping region 28, not visible here, that extends substantially parallel to the first long side 2 of the sanding sheet holder 1. Elastic rollers 29 (for instance of rubber) are located in the clamping region 28 and enter into opposition to the tensioning sheet 8 embodied in the extension of the sanding sheet holder 1, and there in particular with respect to the extensions 18 of the tensioning sheet, which have the elastic lining 20 on the underside 19. On the end of the clamping bail 4 remote from the reverse bend 25, the tensioning lever 7 is embodied, which serves the purpose of pivoting/rotating the clamping bail 4 in the bearing points 5. By pivoting the clamping bail 4 in the bearing points 5 (by means of moving the tensioning lever 7 in the direction R toward the top side 6 of the sanding sheet holder 1), the clamping region 28 of the clamping bail 4 is shifted in location toward the extensions 18 of the tensioning sheet 8. The sanding sheet 21 located between the clamping region 28 and the tensioning sheet 8 is grasped and fixed on its underside by the elastic supports 29 and on the top by the elastic lining 20 of the extensions 18.

Figure 3:
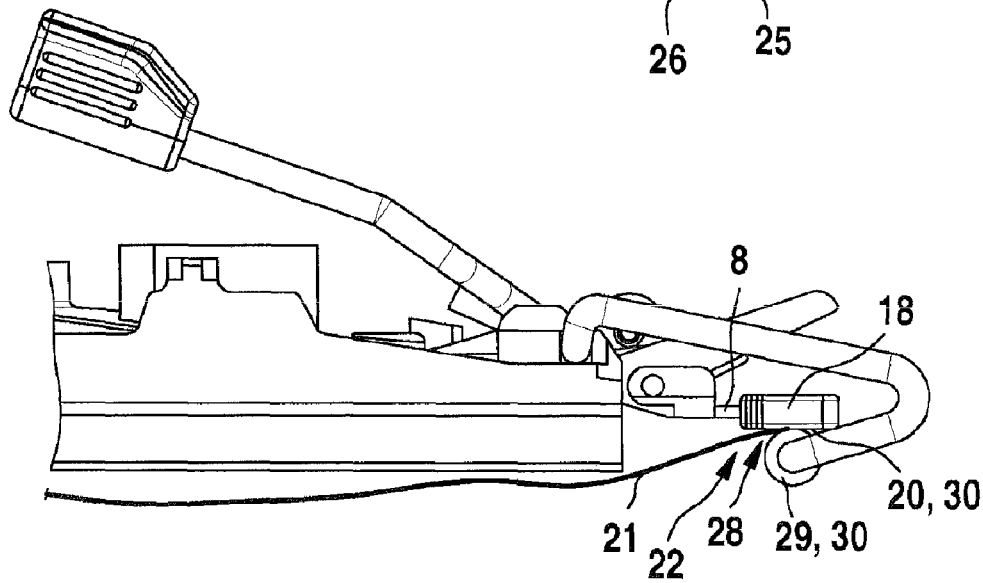
FIG. 3, the first clamping means upon clamping of the sanding sheet.

FIG. 3 shows how the sanding sheet 21 is grasped and fixed by its front end 22 between the clamping region 28, namely its elastic supports 29 in particular, and the elastic lining 20 of the extensions 18 of the tensioning sheet 8. In the situation shown here, it is practically no longer possible (if at all, only under strong tension) for the sanding sheet 21 to slide out from the clamping region 28. The elastic supports 29 and the elastic linings 20 thus act as gripping aids 30, which accomplish an at least temporary fixation of the sanding sheet 21, already in the course of the tensioning operation.

Figure 4:
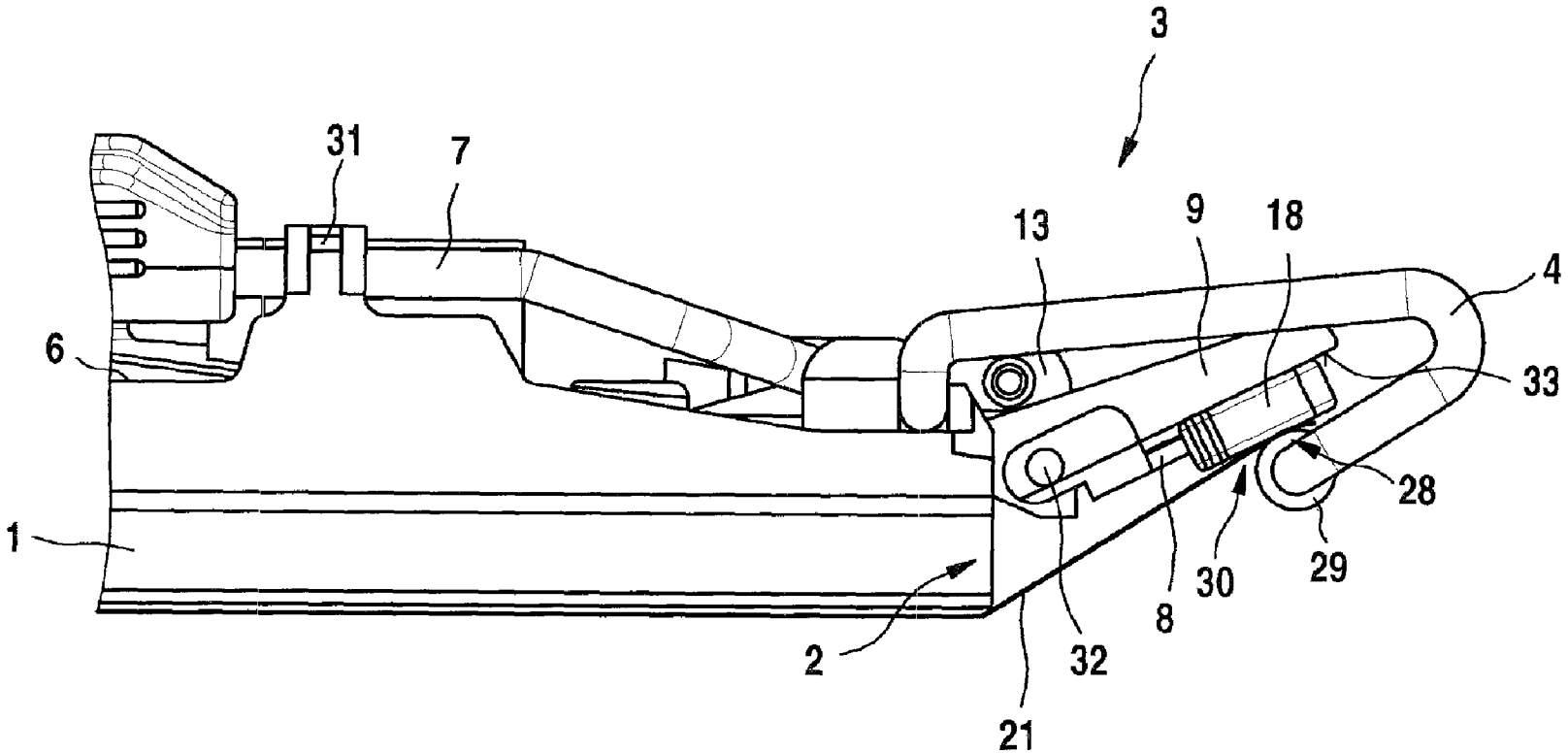
FIG. 4, the first clamping means in the terminal tensioning position.

FIG. 4 shows the first arrangement comprising the sanding sheet holder 1 and the first clamping means 3 in the terminal tensioning position. The tensioning lever 7 here is shifted into its terminal position, essentially parallel to the top side 6 of the sanding sheet holder 1, and is held there, for instance by a locking lug 31. The sanding sheet 21, held by the gripping aids 30 of the clamping region 28 and of the extensions 18, has been moved away relative to the first longitudinal end 2 of the sanding sheet holder 1 and has thus been tension-clamped. In this position, the tensioning sheet 8, which for this purpose is rotatably supported in an axis 32 of rotation, has been moved, counter to the spring load from the torsion spring 13, together with the clamping bail 4 by the upward motion thereof upon lowering of the tensioning lever 7 in the direction of the stop element 9, until this motion was mechanically limited by the stop of the extensions 18 on an underside 33 of the stop element 9. To vary the degree of the tension clamping, the stop element 9 can be embodied angularly adjustably relative to the sanding sheet holder 1, so that the terminal tensioning position (when the extensions 18 meet the stop element underside 33) can be adapted. The result in the terminal tensioning position of the first clamping means 3 with the sanding sheet 21 is thus a terminal position, mechanically fixed and precisely defined by the stop element 9, in which position the clamping bail 4 may be okay after all to say "clamping" for both terms] and other elements serving to clamp the sanding sheet 21, are not set to vibrating and in particular are not put in a condition of natural resonance.

The invention claimed is:

1. A power sander comprising a sanding sheet holder and clamping means for firmly clamping opposed sanding sheet ends of a sanding sheet that is braceable on the sanding sheet holder, of which first clamping means are movable jointly with a sanding sheet end clamped to them away from the other sanding sheet end, clamped by second clamping means, for tension clamping of the sanding sheet, and the first clamping means have spring elasticity, wherein the first clamping means (3), in a terminal clamping position, acts with initial tension against a rigid stop element (9), which stop element (9) is either embodied in one piece with the sanding sheet holder (1) or is embodied as a separate part from the sanding sheet holder (1) and is rigidly connected to the sanding sheet holder (1).

2. The power sander as defined by claim 1, wherein the rigid stop element (9) is embodied adjustably relative to the sanding sheet holder (1) so as to assume relative to the sanding sheet holder (1) various positions, and in each of the positions the stop element (9) is rigidly connected to the sanding sheet holder (1), further comprising means for rigidly connecting the stop element (9) to the sanding sheet holder (1) in each of the positions.

3. The power sander as defined by claim 1, wherein means selected from the group consisting of the first clamping means (3), the second clamping means and both has elastically deformable gripping aids (30).

4. The power sander as defined by claim 1, wherein the first clamping means (3) are embodied as a clamping bail (4) and a tensioning sheet (8).

5. The power sander as defined by claim 1, wherein the tensioning sheet (8) is supported rotatably about a transverse axis relative to the sanding sheet holder (1).

6. The power sander as defined by claim 1, wherein the tensioning sheet (8) is spring-loaded.

7. The power sander as defined by claim 1, wherein the tensioning sheet (8) comprises material selected from the group consisting of spring-elastic material or has a spring-elastic material.

8. The power sander as defined by claim 1, wherein the clamping bail (4) is supported rotatably about a transverse axis of the sanding sheet holder (1) and has a tensioning lever (7).

9. The power sander as defined by claim 1, configured as an orbital sander.

10. The power sander as defined by claim 2, wherein the rigid stop element (9) is angularly adjustable, relative to the sanding sheet holder (1).

11. The power sander as defined by claim 3, wherein the elastically deformable gripping aids (30) are rubber.

12. The power sander as defined by claim 3, wherein the elastically deformable gripping aids (30) form at least part of means selected from the group consisting of the first clamping means (3), the second clamping means and both.

13. The power sander as defined by claim 3, wherein means selected from the group consisting of the first clamping means (3), the second clamping means and both include partial regions comprising elastically deformable gripping aids (30).

14. The power sander as defined in claim 2, wherein the means for rigidly connecting the stop element (9) to the sanding sheet holder (1) is means selected from the group consisting of screws and latches.

* * * * *